US006725752B1

(12) United States Patent
Torrazza

(10) Patent No.: US 6,725,752 B1
(45) Date of Patent: Apr. 27, 2004

(54) MAIL PROCESSING MACHINE

(75) Inventor: Eduardo S. Torrazza, Santa Fe (AR)

(73) Assignee: Catawa, Inc., Plantation, FL (US)

( * ) Notice: Subject to any disclaimer, the term of this patent is extended or adjusted under 35 U.S.C. 154(b) by 0 days.

(21) Appl. No.: 10/277,671

(22) Filed: Oct. 21, 2002

(30) Foreign Application Priority Data

Oct. 22, 2001 (AR) ..... P010104936

(51) Int. Cl.[7] ..... B26D 7/06; B26D 5/08

(52) U.S. Cl. ..... 83/156; 53/381.3; 414/412; 83/408; 83/614; 83/912

(58) Field of Search ..... 83/912, 933, 934, 83/614, 408, 156; 53/381.2, 381.3, 381.4, 381.5, 382.3; 414/403, 412, 786; 271/2; 209/900

(56) References Cited

U.S. PATENT DOCUMENTS 3,238,926 A * 3/1966 Huck ..... 53/381.3
3,301,116 A * 1/1967 Owen ..... 83/444
3,529,756 A * 9/1970 Smith ..... 83/912
3,739,543 A * 6/1973 Harris ..... 53/381.5
4,159,611 A * 7/1979 Russell ..... 53/381.3
4,373,848 A * 2/1983 Bishop ..... 414/403
4,478,023 A * 10/1984 Becker ..... 53/382.3
4,866,915 A * 9/1989 Wise ..... 53/381.5
4,921,388 A * 5/1990 Nelson ..... 414/412
5,061,146 A * 10/1991 Nelson ..... 414/412
5,096,360 A * 3/1992 Nelson ..... 414/412
5,131,545 A * 7/1992 Owen ..... 271/2
5,156,515 A * 10/1992 Charron et al. ..... 414/412
5,336,034 A * 8/1994 Hidding ..... 414/403
5,440,861 A * 8/1995 Lund ..... 53/381.3
5,474,414 A * 12/1995 Tovini et al. ..... 414/412
5,675,959 A * 10/1997 Hamma et al. ..... 53/381.3
5,946,996 A * 9/1999 Oussani, Jr. et al. ..... 83/912
6,092,353 A * 7/2000 Baumann ..... 53/381.3
6,196,393 B1 * 3/2001 Kruk et al. ..... 53/381.3
6,230,471 B1 * 5/2001 Robertson et al. ..... 53/381.3
6,505,534 B2 * 1/2003 Robertson et al. ..... 83/912
6,547,078 B1 * 4/2003 Lile et al. ..... 209/900
6,612,211 B1 * 9/2003 Stigliano et al. ..... 53/381.3

* cited by examiner

*Primary Examiner*—Allan N. Shoap
*Assistant Examiner*—Jason Prone
(74) *Attorney, Agent, or Firm*—J. Sanchelima; A. Bordas

(57) ABSTRACT

A machine for processing envelopes includes a receiving assembly with a tray where envelopes are received and guided towards an envelope cutting assembly. A sensor determines the width of the envelope to align on of the two longitudinal cutting members. Another sensor detects the leading and railing edge of the envelope and with a circuit control the advancement of the envelope to cooperative positions that permit another cutter member to act transversally. The envelope is then passed to an unfolding assembly where the uppermost and lowermost sheets are loose and sandwich inbetween the contents. The uppermost sheet is pulled out to the display assembly that is hermetically closed. Subsequently, a transversally moving roller is used to lift the folds of the content, if any, and to affix the unfolded contents to protruding pins. The engagement with the protruding pins is slowly undone as the contents are pushed towards the display assembly.

5 Claims, 6 Drawing Sheets

MAIL PROCESSING MACHINE

II. BACKGROUND OF THE INVENTION

1. Field of the Invention

The present invention relates to a mail-processing machine, and more particularly, to a machine that opens and discards the envelopes, exposing the document contained therein.

2. Description of the Related Art

Many designs for mail processing machine have been designed in the past. None of them, however, includes a system for receiving envelopes of different sizes, open them and exposed the enclosed document inside hermetically sealed container. Contact with the user is thus avoided.

III. SUMMARY OF THE INVENTION

It is one of the main objects of the present invention to provide a mail processing machine that opens, unfolds and displays the documents contained therein avoiding contact with the user.

It is another object of this invention to provide such a machine that processes envelopes of different sizes.

It is yet another object of this invention to provide such a machine that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

Figure 8A:
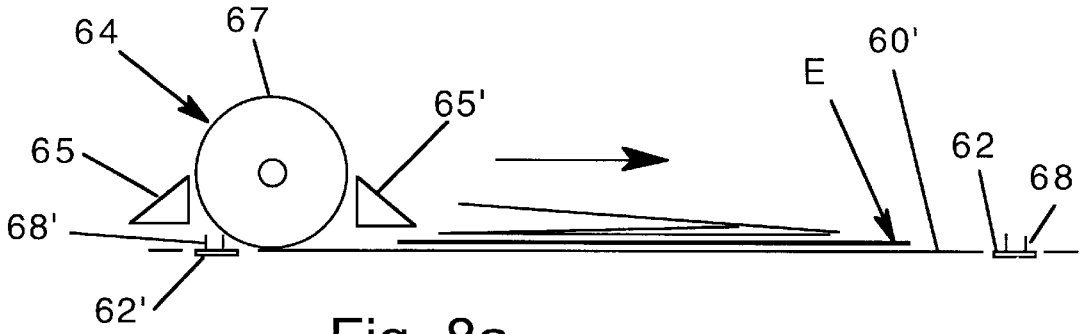

FIG. 8*a* is a schematic representation of the first step in the unfolding folded contents.

Figure 8B:
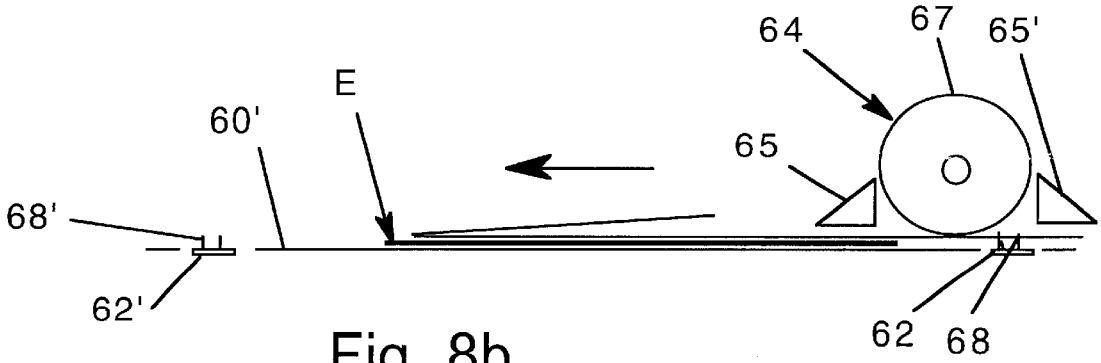

FIG. 8*b* is a schematic representation of the second step in the unfolding folded contents.

Figure 8C:
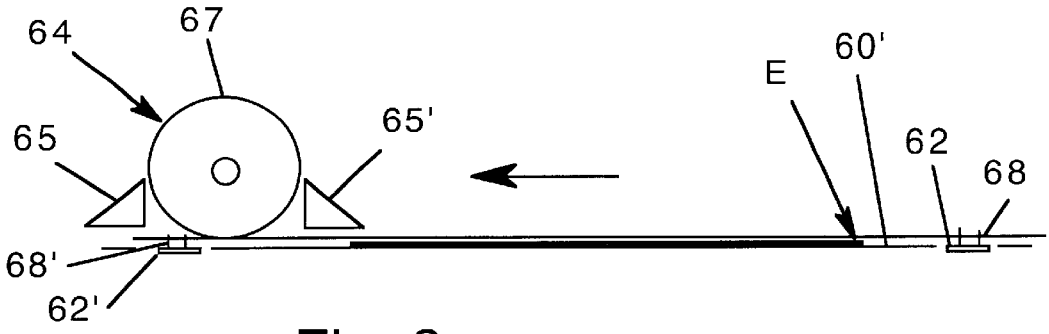

FIG. 8*c* is a schematic representation of the third step in the unfolding folded contents.

Figure 9:
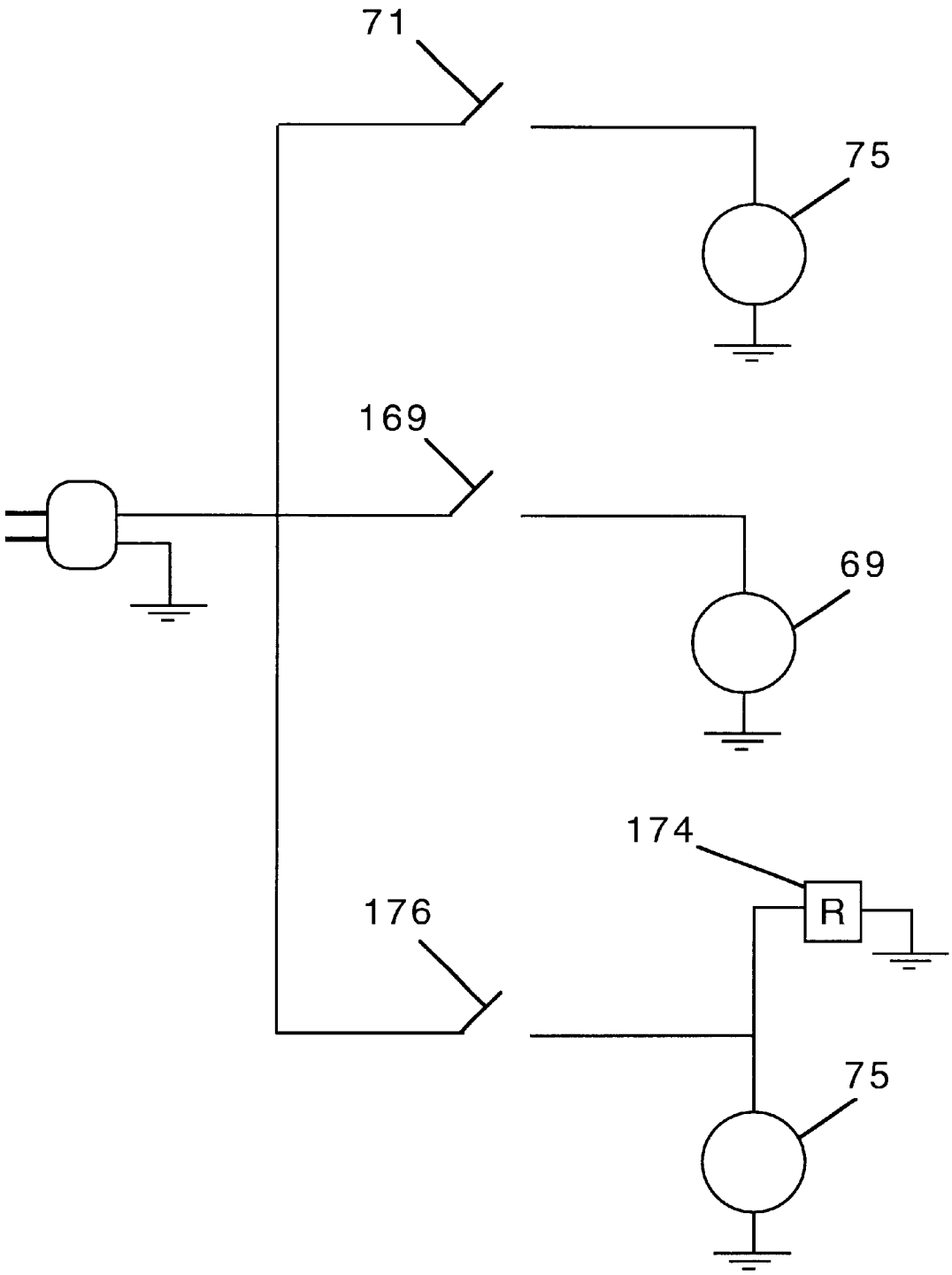

FIG. 9 is a schematic representation of an electrical circuit implementing the motors associated to the unfolding and outlet assemblies.

V. DETAILED DESCRIPTION OF THE PREFERRED EMBODIMENT

Referring now to the drawings, where the present invention is generally referred to with numeral 10, it can be observed that it basically includes receiving assembly 20, cutting assembly 40, unfolding assembly 60, outlet assembly 70 and display container assembly 80.

Figure 2:
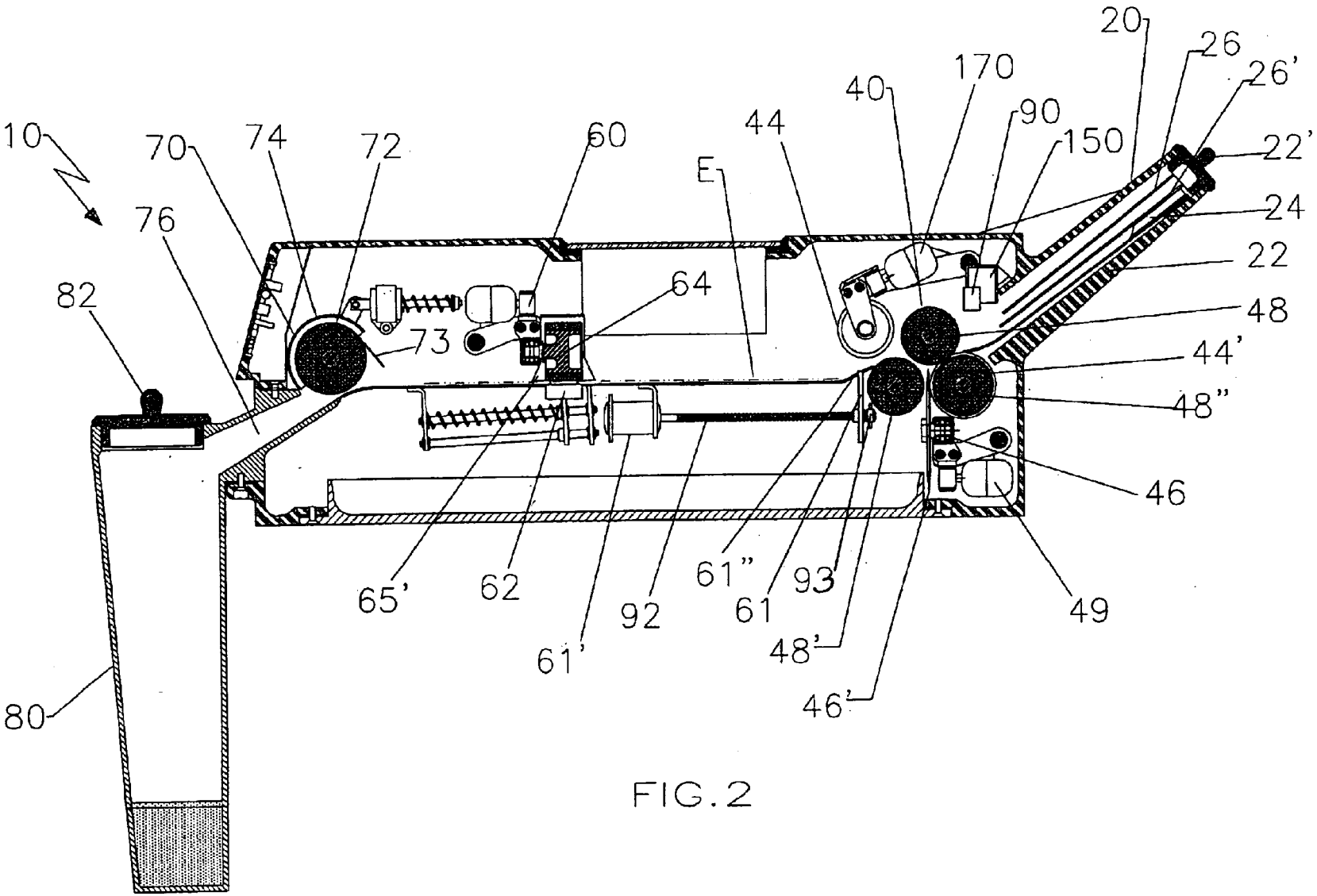
FIG. 2 shows a cross sectional view of the mail processing machine taken along line 2—2 in FIG. 1, showing the internal mechanism of the machine.
Figure 3:
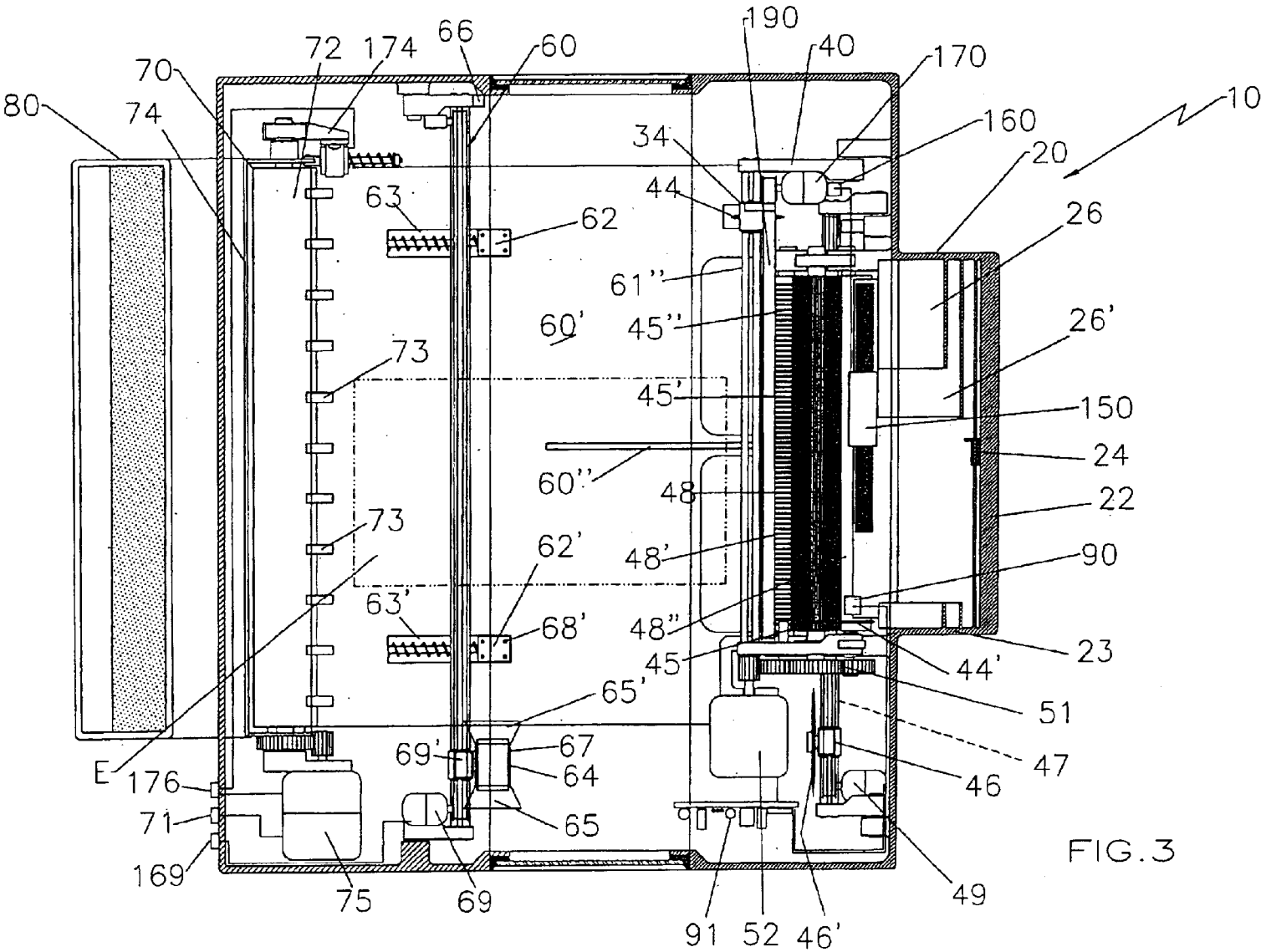
FIG. 3 illustrates a cross sectional view of the mail-processing machine taken along line 3—3 in FIG. 1, showing the internal mechanism of the machine.

Receiving assembly 20 includes tray 22 with movable rail 24, fixed rails 26 and 26' therein, and cap 22', as seen in FIGS. 2 and 3. Tray 22 can be positioned preferably at an angle, depending on the user's preference. Envelopes E placed inside tray 22 moved downwardly by gravity. Fixed rails 26 and 26' are cooperatively mounted with respect to reference wall 23 to match two standard width dimensions of envelopes E. Movable rail 24 can be moved with respect to reference wall 23 to receive envelopes E of different width dimensions. Once a user manually adjusts movable rail 24 (or uses fixed rails 26 and 26') and places envelope E (shown in phantom) inside tray 22, cap 22' is closed. The leading end of envelope E protrudes outwardly from receiving assembly 20 and comes within cutting assembly 40. When envelope 20 is detected by sensor assembly 150 a signal is sent to positioning circuit 160 which in turn causes motor assembly 170 to rotate and, through belt assembly 190, transversally positions cutting member 34. Cutting member 34 includes blade member 44 that is rotably mounted on member 34. This mechanism is similar to those used with electric typewriters that bring the typing carriage to a predetermined position along the roller.

Cutting assembly 40 includes roller assemblies 48, 48' and 48", as best seen in FIGS. 2 and 3. The leading edge of envelope E is positioned between roller assemblies 48 and 48". Sensor assembly 90 detects the leading edge of envelope E and is connected to control circuit 91 that in turn selectively actuates motor assembly 52. As envelope E is detected and control circuit 91 activates motor assembly 52, longitudinal cutting member 44' starts cutting the lateral edge of envelope E aligned with reference wall 23. Cutting member 44' is rigidly mounted to roller assembly 48" and is driven by gear assembly 51, which in turn is driven by motor assembly 52. Envelope E is allowed to go through a predetermined distance by control circuit 91. This mechanism is similar to what is used in fax equipment today where the roller take in the edge of the paper to place it at a reference position. Cutting member 46 starts to transversally cut envelope E at a predetermined distance from its leading edge. Cutting member 46 moves transversally back and forth by motor assembly 49 over worm gear 47. Cutting member 46 includes rotably mounted blade member 46', which coincides with longitudinal grooves 45" in roller 48.

After the leading edge is cut off, envelope E advances and cutting member 44' continues its longitudinal cut at a predetermined distance from its lateral edge until envelope E goes through. A cooperating groove 45 in roller assembly 48 receives cutting member 44' to ensure a through cutting operation. The trailing edge of envelope E is similarly detected by sensor 90 and circuit 91 immediately stops motor assembly 52. Envelope E is transversally cut by cutting member 46 at a predetermined distance from the trailing edge. Cutting member 46 is actuated by sensor circuits 90 cooperatively positioned along the path of enveloped E.

Figure 5:
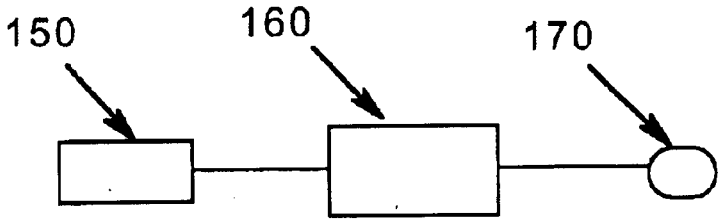
FIG. 5 is a schematic representation of the circuit implemented for the bar code reader associated to the movable longitudinal cutting member.
Figure 6:
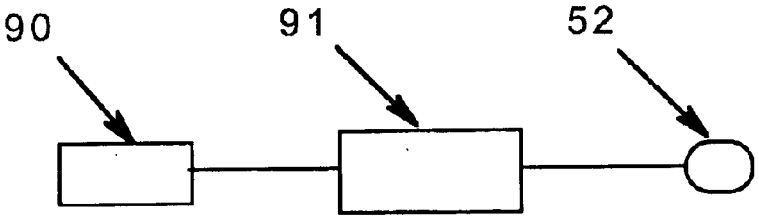
FIG. 6 is a schematic representation of the circuit implemented for the sensor associated to the movable transversal cutting member.

Longitudinal cutting member 34 is movable in response to the output generated by sensor assembly 150 applied to circuit 160, which in turn activates motor assembly 170, as best seen in FIG. 5. Roller assembly 48' includes a plurality of grooves 45' that receive blade member 44 to ensure a through cut along the other lateral edge of envelope E.

Envelope E is then introduced into unfolding assembly 60 and deposited on top of surface 60'. Slot 60" allows pin 61 to go through supporting elongated and transversally disposed positioning member 61". Member 61" pushes envelope E from its trailing end. Motor assembly 61' provides rotation to worm gear 92, which causes carrier 93 to advance. Pin 61 is mounted to carrier 93. Once the leading end of envelope E comes in contact with roller member 72, a user activates motor assembly 75 through switch 71. Soft nails 73 are cooperatively mounted to roller member 72 to frictionally pull the upper cut sheet of envelope E to advance through duct 76. In this manner, contents C of envelope E are exposed and rest over the interior surface of the other cut sheet of envelope E.

Figure 1:
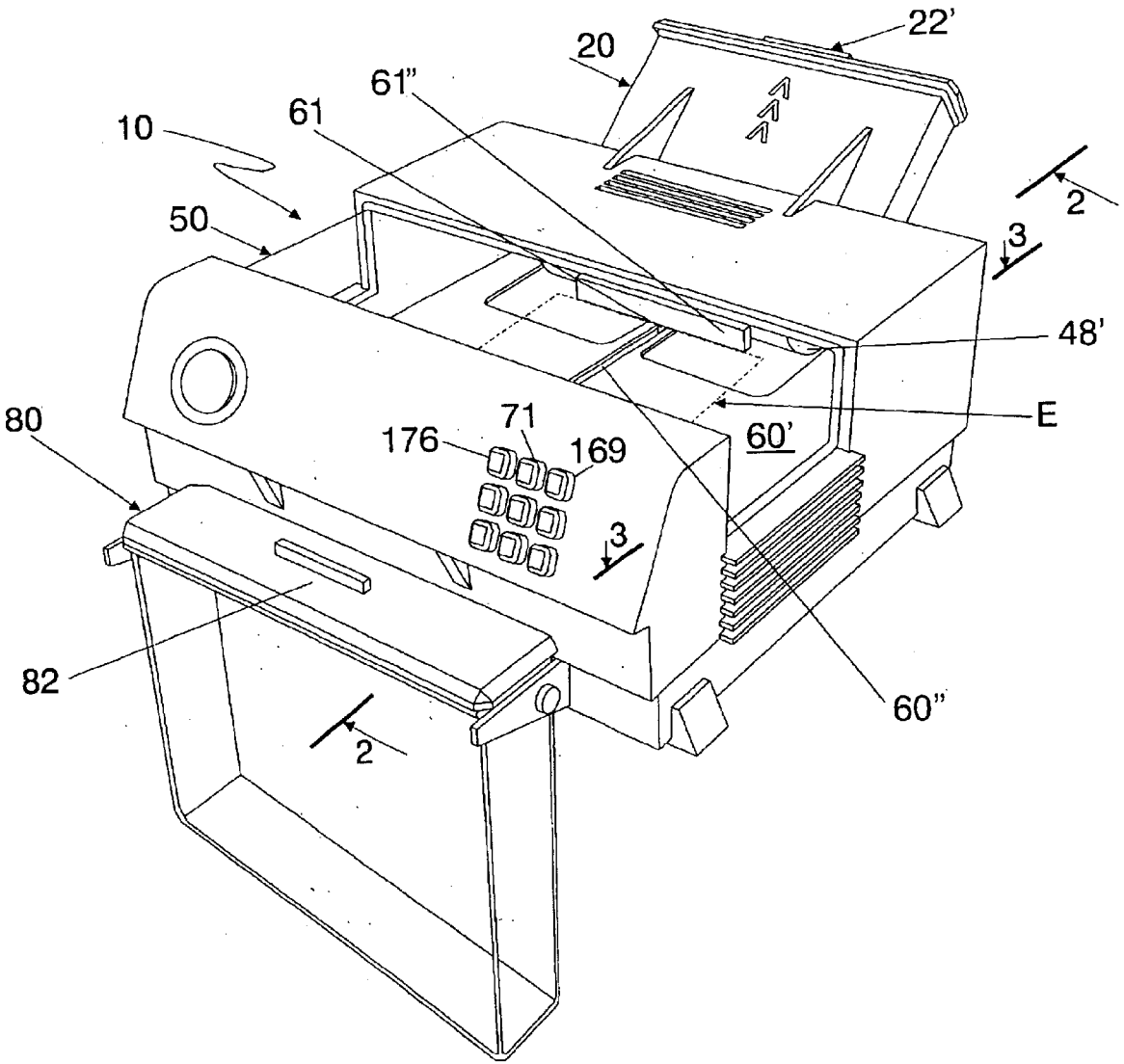
FIG. 1 represents an isometric view of one of the preferred embodiments for the mail processing machine object of the present application.

Transparent cover 50, as shown in FIG. 1, is over unfolding assembly 60 of mail processing machine 10. The user can observe the position of envelope E and decide when to operate the mechanism in unfolding assembly 60 and outlet assembly 70.

Figure 7:
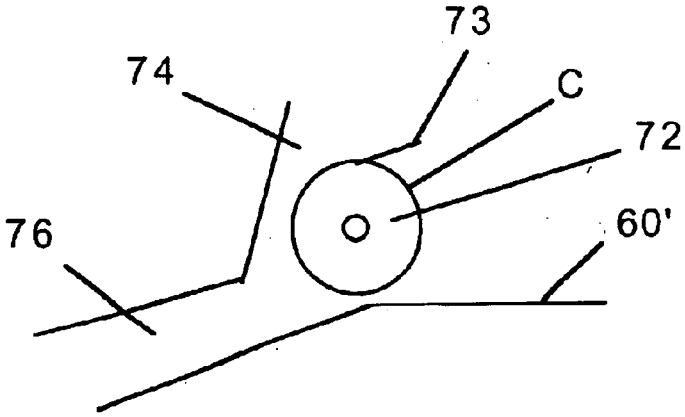
FIG. 7 is a schematic representation of one embodiment for turning the contents upside down using a relay assembly that is actuated by a user causing the roller cover to move blocking the entrance to the duct and forcing the envelope to go over the roller and back to the flat surface.

If the folds of contents C are upside down, then an additional step is required. A user actuates switch 176, which causes relay assembly 174 for roller cover 74 moves blocking the entrance to duct 76, as shown in FIG. 7. Contents C is pushed to advance towards roller member 72 and returned to surface 60' with the folds upwardly exposed.

Next, the lower cut sheet of envelope E is below its contents C (typically one or more sheets with two folds). Then, if contents C include folded sheets, unfolding carrier assembly 64 is activated to advance transversally lifting one of the folds. This can be seen in FIGS. 8*a*, 8*b* and 8*c*. Unfolding fin member 65' moves towards the folded contents C to lift the uppermost fold. Roller member 67 is positioned behind fin member 65' pressing the uppermost fold flat against surface 60'. Holding pin assemblies 62 and 62' includes several pin members 68 and 68' that punctures the unfolded portion of contents C.

As seen in FIGS. 8*a*, 8*b* and 8*c*, once it reaches the end, roller member 67 presses the distal portion of the unfolded contents C against pin members 68 and 68' holding it flat against surface 60'. Roller member 67 is made out of a soft material like foam. On its return, fin member 65 of unfolding carrier assembly leads the way and lifts the other fold of contents C. As before, roller member 67 presses against pin members 68' holding this unfolded portion against surface 60'. Carrier assembly 64 is moved transversally by motor assembly 69, which is activated by switch 169, causes belt 69' to move in both directions. Limit switch assembly 66 causes the rotation of motor assembly 69 to change in direction.

After the document has been unfolded, the user activates roll member 72 and nails 73 pulling documents towards duct 76. As the document advance to duct 76, pin members 62 and 62' retracts below surface 60' releasing the punctured contents C. Contents C are then pulled in towards duct 76 by soft nails 73. Finally, soft nails 73 pull in the lowermost cut sheet of envelope E and all the components are deposited inside transparent container 80.

Display container assembly 80 includes hermetically closed cap 82. Container 80 is made out of a transparent material such as plastic. The base of container 80 is sufficiently large to facilitate the irregular falling of the sheets so the user can inspect the contents and detect any extraneous elements contained therein.

Figure 4:
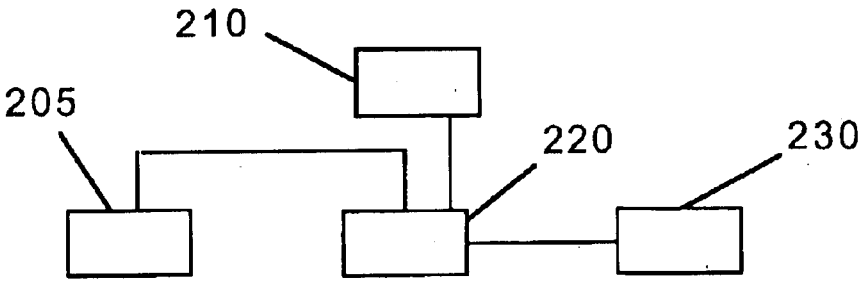
FIG. 4 is a schematic representation of the circuit implemented for the additional fixtures added to the invention such as scanners, printer and modem.

The present invention can be implemented manual or automatic operation depending on how much control a user desires and/or the uniformity of the dimensions of the envelopes being processed. Also, additional fixtures, as shown in FIG. 4 can be added to this invention such as scanners 205 and 210 mounted at the opposite sides of duct 76, printer 220 and modem 230. In this way the user can read process and transmit the documents without opening mail processing machine 10 if necessary.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A hermetic machine for processing envelopes, comprising:

A) a receiving assembly including a tray member with first and second ends, said first end including an opening for receiving an envelope enclosing contents therein having leading and trailing edges and two opposite lateral edges, and at least one guiding rail and one reference wall for aligning said envelope over an inclined first surface so that said envelope is urged towards said second end by gravity;

B) a cutting assembly having first roller means for receiving and pulling said envelope through and including first and second cutting means for longitudinally cutting said envelope at predetermined distances from said lateral edges, said cutting assembly further including sensor means for detecting said leading and trailing edges and control means for activating and deactivating said first roller means to start and stop the advancement of said envelope through said first roller means and said cutting assembly further including third cutting means for transversally cutting said envelope at predetermined distances from said leading and trailing ends causing said envelope to result in a separate uppermost and lowermost sheets, and contents sandwiched inbetween;

C) an unfolding assembly including first and second ends and a flat surface inbetween that is horizontally disposed for receiving said envelope from said cutting assembly and further including means for pushing said envelope from its trailing edge towards said second end;

D) an outlet assembly having second roller means mounted at said second end for selectively pulling outwardly said uppermost sheet, contents and lowermost sheet through said second end; and E) a display assembly having a transparent container with third and fourth ends, said third end including an opening connected to said second end to receive the envelope pushed therethrough so that a user may inspect said uppermost and lowermost sheets of said envelope as well as said contents without coming in contact with these objects.

2. The machine set forth in claim 1 wherein said contents include sheets with folded portions and said unfolding assembly includes a transversally moving third roller means having first and second fin members mounted in front and behind said third roller means, said first and second fin members being positioned above said flat surface a predetermined cooperative distance to permit a lifting action of said folded portions as said third roller means moves transversally across said contents with folded portions to unfold same.

3. The machine set forth in claim 2 wherein said unfolding assembly further includes a plurality of pins protruding upwardly through said flat surface in cooperative disposition with said first roller means to engage said contents thereby engaging said unfolded portions.

4. The machine set forth in claim 3 wherein said unfolding assembly includes means for turning said contents upside down.

5. The machine set forth in claim 4 wherein said receiving assembly includes first sensor means for determining the width of said envelopes and the position of said first cutting means being controlled by said first sensor means so that said longitudinal cut takes places at a predetermined longitudinal location along said envelope.

* * * * *